US008865302B2

(12) United States Patent
Jung et al.

(10) Patent No.: US 8,865,302 B2
(45) Date of Patent: Oct. 21, 2014

(54) ELECTROPHOTOGRAPHIC RECORDING MEDIUM

(75) Inventors: Chang-Woo Jung, Suwon-si (KR); Taek-Yong Jung, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 680 days.

(21) Appl. No.: 12/606,426

(22) Filed: Oct. 27, 2009

(65) Prior Publication Data

US 2010/0129746 A1 May 27, 2010

(30) Foreign Application Priority Data

Nov. 25, 2008 (KR) ..... 10-2008-0117637

(51) Int. Cl.
*G03G 5/04* (2006.01)
*G03G 7/00* (2006.01)

(52) U.S. Cl.
CPC ..... *G03G 7/0013* (2013.01); *G03G 7/002* (2013.01); *G03G 7/004* (2013.01)
USPC ..... 428/323; 430/56; 430/96; 430/127

(58) Field of Classification Search
USPC ..... 428/323; 430/96, 127, 56
See application file for complete search history.

(56) References Cited

U.S. PATENT DOCUMENTS

| | | | | |
|---|---|---|---|---|
| 6,447,114 | B1 * | 9/2002 | Sunderrajan et al. | 347/105 |
| 2004/0247804 | A1 * | 12/2004 | Kim et al. | 428/32.36 |
| 2005/0238827 | A1 * | 10/2005 | Kozumi | 428/32.24 |
| 2006/0046030 | A1 | 3/2006 | Shiba | |
| 2008/0113287 | A1 * | 5/2008 | Nakamura et al. | 430/104 |
| 2008/0182200 | A1 * | 7/2008 | Kim | 430/270.14 |
| 2008/0268366 | A1 * | 10/2008 | Nakayama et al. | 430/110.3 |
| 2009/0023086 | A1 * | 1/2009 | Kim | 430/109.3 |
| 2011/0244147 | A1 * | 10/2011 | Wang et al. | 428/32.35 |

FOREIGN PATENT DOCUMENTS

| | | | |
|---|---|---|---|
| JP | 2002-062679 | A | 2/2002 |
| KR | 10-2008-0070197 | A A | 7/2008 |
| WO | WO 2004/029725 | A1 | 4/2004 |

OTHER PUBLICATIONS

Korean Notice of Preliminary Rejection dated Mar. 6, 2014 issued in corresponding Korean Patent Application No. 10-2008-0117637.

* cited by examiner

*Primary Examiner* — Ronak Patel
(74) *Attorney, Agent, or Firm* — Staas & Halsey LLP

(57) ABSTRACT

An electrophotographic recording medium can have a first layer of base material and a second layer formed on one or both surfaces of the first layer for fixing toner. The second layer can include a hollow pigment, an inorganic material and a binder resin. The amount of the hollow pigment can be in the range of about 10% to about 50% by weight based on the total weight of the second layer. The ratio of the white paper glossiness before and after printing on the recording medium may be greater than 1.5.

7 Claims, 1 Drawing Sheet

ELECTROPHOTOGRAPHIC RECORDING MEDIUM

CROSS-REFERENCE TO RELATED APPLICATIONS

This application claims the benefit under 35 U.S.C. §119 (a) of Korean Patent Application No. 10-2008-0117637, filed on Nov. 25, 2008, in the Korean Intellectual Property Office, the entire disclosure of which is hereby incorporated by reference.

TECHNICAL FIELD

The present disclosure generally relates to an electrophotographic recording medium, and more particularly, to an electrophotographic recording medium for use in an electrophotographic printer that has improved print glossiness and image quality, and to a method of manufacturing the same.

BACKGROUND OF RELATED ART

As computer application technologies have become widespread in recent years, various types of documents and images are being produced using computers, and are being printed using printers. Such printers include, for example, dot-matrix impact printers, laser printers, thermal printers, inkjet printers, and the like. Among these printers, laser printers, which use a laser beam in printing (also referred to as electrophotography), and inkjet printers are widely used by general consumers because of their high printing speeds and their ability to print high-resolution images.

Electrophotography, when used in copiers and/or printers, generally has several imaging processing steps. A photoconductive drum or belt is charged to a constant potential in a dark environment. A Laser beam is irradiated on the charged surface of the photoconductive drum or belt to form electrostatic latent images thereon. The electrostatic latent images are developed with developer, e.g., charged toner, where the toner is transferred onto the electrostatic latent images formed on the photoconductive drum or belt by, e.g., electrostatic force, to form toner images.

A recording medium is made to move past the photoconductive drum or the belt so that the toner image is transferred therefrom onto the recording medium. The recording medium may be conductive, at least to some extent, in order for the toner images to be transferred thereto by electrostatic force. The toner image transferred to the recording medium is fixed thereon by a hot fusing process in which heat and pressure are applied to the recording medium typically with the use of one or more rollers.

Electrophotographic printers employing the electrophotography process generally described above can use various recording media, including paper. With improvements in the performance of toner that is used in electrophotographic printers, and with enhancements in the transferring and fixing technologies, recording media suitable for use in electrophotographic printers have become more widely available. For example, highly glossy recording medium is available for use with inkjet printers.

Generally, a sheet of paper or printing medium suitable for use with electrophotographic printers is formed by coating a toner fixing layer on one side or on both sides of a base layer. More particularly, a filler and a binder resin are mixed in a suitable ratio to prepare a composition used to form the toner fixing layer. The composition is then coated on the base layer. Such a toner fixing layer enables a printing medium used for electrophotographic printers to have excellent smoothness and glossiness compared to ordinary paper. The smoothness and the glossiness of the recording media may affect the print glossiness during printing, and could significantly influence the print quality.

To increase the smoothness and the glossiness of a conventional electrophotographic recording medium, an inorganic material having small-sized particles can be used or attempts to improve the conditions, e.g., temperature and pressure conditions, during the calendering process can be made. However, when an inorganic material having small-sized particles is used in a conventional electrophotographic recording medium, the cost may become disadvantageously high and/or it may be difficult to treat the inorganic material due to the small particle size. When, an inorganic material of a large particle size is used, on the other hand, a calendering process may be required.

During the calendering process, the temperature and pressure are adjusted to achieve a varying degree of thickness, smoothness and/or glossiness of recording media. More particularly, the calendering process enables the heat and the pressure that is applied to a recording medium to improve the smoothness of a surface of the recording medium. Generally, as the smoothness of the surface improves, the glossiness of the surface is also improved.

As the temperature and the pressure increase, the thickness of the recording media decreases while the smoothness and the glossiness of the recording media improve. Excessively high temperature and/or pressure, however, can be a source of problems in the manufacturing of the recording media. An inappropriate choice of the base layer can also influence the toner fixing layer. It may thus be generally advantageous to apply suitably temperature and/or pressure.

As another attempt to improve upon the glossiness of recording media, a plastic pigment can be used to form a toner fixing layer so as to improve the glossiness, the opacity and the printability of the recording media. However, such use of plastic pigments to yield high glossiness may also require a calendering process.

SUMMARY OF THE DISCLOSURE

According to an aspect of the present disclosure, there is provided an electrophotographic recording medium that may include a base layer defining two surfaces and a toner fixing layer covering at least on one of the two surfaces defined by the base layer. The toner fixing layer may comprise a hollow pigment, an inorganic material and a binder resin. The amount of the hollow pigment included in the toner fixing layer may be in the range of about 10 to about 50 percent by weight based on the total weight of the toner fixing layer. The white paper glossiness ratio $G_p/G_0$ may be greater than 1.5 where $G_0$ and $G_p$ represent the white paper glossiness of the electrophotographic recording medium as measured respectively before and after printing on the electrophotographic recording medium.

The mean particle size of the hollow pigment may be in the range of about 0.01 μm to about 2 μm.

The toner fixing layer may include the inorganic material in an amount that is equal to or greater than the binder resin included the toner fixing layer.

The content ratio of the inorganic material to the binder resin may be in the range of about 95:5 to about 50:50.

The inorganic material may comprise at least one selected from the group consisting of kaolin clay, calcium carbonate, talc, alumina, aluminum hydroxide, satin white, silica, titanium dioxide, calcined clay, zinc oxide and barium sulfate.

For example, the inorganic material may comprise calcium carbonate.

The binder resin may comprise at least one selected from the group consisting of polyvinyl alcohol, polyvinyl pyrrolidone, cellulose, gelatin, polyethylene oxide, acryl, polyester, polyurethane, latex, and a quaternary ammonium-based copolymer.

The toner fixing layer may further comprise an additive agent.

The additive agent may be a fluorescent dye in the range of about 0.01 percent by weight to about 0.5 percent by weight based on the total weight of the toner fixing layer.

The additive agent may comprise at least one selected from the group consisting of a fluorescent dye, a hardener, a whitening agent, a light diffusing agent, a pH adjuster, an antioxidant, an antifoaming agent, a leveling agent, a lubricant, an anti-curling agent, a surfactant and an anticorrosion agent.

The amount of the hollow pigment in the toner fixing layer may be in the range of about 15 percent by weight to about 40 percent by weight based on the total weight of the toner fixing layer.

The toner fixing layer may be formed from a composition that includes about 2 parts by weight of a polyvinyl alcohol, about 8 parts by weight of a latex, about 70 parts by weight of a calcium carbonate and about 20 parts by weight of the hollow pigment.

In the alternative, the toner fixing layer may be formed from a composition that includes about 2 parts by weight of a polyvinyl alcohol, about 8 parts by weight of a latex, about 60 parts by weight of a calcium carbonate and about 30 parts by weight of the hollow pigment.

As another alternative, the toner fixing layer may be formed from a composition that includes about 2 parts by weight of a polyvinyl alcohol, about 8 parts by weight of a latex, about 50 parts by weight of a calcium carbonate and about 40 parts by weight of the hollow pigment.

According to another aspect of the present disclosure, a method of manufacturing a recording medium may include the steps of providing a base layer of a substrate material; preparing a toner fixing material comprising a hollow pigment, an inorganic material and a binder resin; and coating at least one surface of the base layer with the toner fixing material so as to form a toner fixing layer covering the at least one surface. The thickness of the toner fixing layer may be in a range of about 5 μm to about 40 μm. The amount of the hollow pigment in the toner fixing layer may be in the range of about 10 to about 50 percent by weight based on the total weight of the toner fixing layer.

The hollow pigment may have a mean particle size in the range of about 0.01 μm to about 2 μm.

The step of preparing the toner fixing material may comprise preparing a mixed composition of a polyvinyl alcohol, a latex, a calcium carbonate and the hollow pigment.

In one example, the mixed composition may include about 2 parts by weight of the polyvinyl alcohol, about 8 parts by weight of the latex, about 70 parts by weight of the calcium carbonate and about 20 parts by weight of the hollow pigment.

In an alternative example, the mixed composition may include about 2 parts by weight of the polyvinyl alcohol, about 8 parts by weight of the latex, about 60 parts by weight of the calcium carbonate and about 30 parts by weight of the hollow pigment.

In another alternative example, the mixed composition may include about 2 parts by weight of the polyvinyl alcohol, about 8 parts by weight of the latex, about 50 parts by weight of the calcium carbonate and about 40 parts by weight of the hollow pigment.

BRIEF DESCRIPTION OF THE DRAWINGS

Various aspects of the present disclosure will become apparent and more readily appreciated from the following description of the embodiments, taken in conjunction with the accompanying drawings, in which.

DETAILED DESCRIPTION OF SEVERAL EMBODIMENTS

Figure 1:
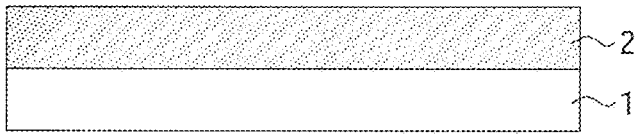
FIG. 1 is a cross-sectional view of an electrophotographic recording medium according to an embodiment of the present disclosure.

Several embodiments of the present disclosure are described below in greater detail with reference to the accompanying drawings.

The matters defined in the description such as a detailed construction and elements are provided to assist in a comprehensive understanding of the embodiments of the disclosure and are merely provided by way of example. Accordingly, those of ordinary skill in the art will recognize that various changes and modifications of the embodiments described herein can be made without departing from the scope and spirit of the disclosure. Also, descriptions of well-known functions and constructions are omitted for clarity and conciseness.

The present disclosure provides an electrophotographic recording medium that can include a base layer and a toner fixing layer that is formed on one surface, or on both surfaces, of the base layer. According to an embodiment, a toner fixing layer can include a hollow pigment, an inorganic material and a binder resin, for example.

The base layer described in the present disclosure can be substantially the same as a base layer of a conventional electrophotographic recording medium, and need not be limited to any particular base layer. Accordingly, any base layer that can, for example, withstand the fixing temperature and that can satisfy certain requirements, such as smoothness, whiteness friction, antistatic property, fixability, or the like, suitable for the purpose of the particular use or application, can be used.

The base layer can be, for example, a paper support, a synthetic paper (e.g., polyolefins, polystyrenes, or the like), a wood free paper, an art paper, a coated paper, a mixed paper prepared from a natural pulp and a synthetic resin pulp (e.g., polyethylene, or the like), a baryta paper, a synthetic resin, an impregnated paper, an emulsion impregnated paper, a synthetic rubber latex impregnated paper, a paperboard, a cellulose tissue paper, or the like. Additionally, the base layer can be a plastic film support, such as polyolefin, polyvinyl chloride, polyethylene terephthalate, polystyrene, polymethacrylate, polycarbonate, or the like.

The base layer can also be a white opaque film prepared by adding a white pigment or filler to the synthetic resin, or a foam sheet prepared by foaming the synthetic resin. The base layer can be of a single type, or a laminated structure having two or more types of materials. For example, the base layer can be a laminate of cellulose tissue paper and synthetic paper or a laminate of cellulose tissue paper and a plastic film.

The thickness of the base layer according to an embodiment can desirably be in the range of about 50 microns (μm) to about 300 μm to, for example, prevent the printing medium from curling after printing.

The toner fixing layer can include hollow pigment, inorganic material and binder resin, and can further comprise additive agents for functional characteristics of the electrophotographic recording medium as needed for the particular application.

The inorganic material to be used in the toner fixing layer, according to an embodiment of the present disclosure, can be any known inorganic material in use for the toner fixing layer of a conventional electrophotographic recording medium, and need not be limited to any particular material or material type.

The inorganic material can be an inorganic pigment, for example. The inorganic pigment can be, for example, kaolin clay, alumina, silica, calcium carbonate, talc, aluminum hydroxide, satin white, titanium dioxide, calcined clay, zinc oxide, barium sulfate, or the like. As further examples, a mixture of any two or more of the materials listed above can also be used as an inorganic pigment.

In some embodiments, it may be desirable to use calcium carbonate as an inorganic material.

While it need not be so limited, the binder resin can be, for example, a polymer with an appropriate molecular weight. While it need not be limited to any one particular material, examples of binder resin that can be used according to embodiments of the present disclosure may include, for example, polyvinyl alcohol, polyvinyl pyrrolidone, cellulose such as methyl cellulose or hydroxypropylmethyl cellulose, gelatin, polyethylene oxide, acryl. Additionally, the binder resin may be, for example, polyester, a polyurethane-based polymer, latex, and a quaternary ammonium-based copolymer. The binder resin can also be a mixture of two or more of the above listed materials.

According to an embodiment of the present disclosure, the amount of the inorganic material contained in the toner fixing layer can be equal to or greater than the amount of the binder resin contained in the toner fixing layer. A content ratio of the inorganic material to the binder resin can desirably be in the range of about 95:5 to about 50:50. When the content ratio of the inorganic material to the binder resin is greater than, for example, 95:5, that is, when the amount of the inorganic material is significantly increased in the toner fixing layer, the adhesion between the base layer and the toner fixing layer can become insufficient, possibly resulting in the separation of the toner fixing layer from the base layer. On the other hand, when the content ratio of the inorganic material to the binder resin is less than, for example, 50:50, that is, when an amount of the binder resin is significantly increased in the toner fixing layer, paper feeding problems, such as jamming or multiple sheets feeding, can occur.

In an embodiment of the present disclosure, a hollow pigment can be used in the toner fixing layer. The hollow pigment can contain pores that are formed after water is evaporated from a plastic pigment during drying. Because of the characteristics of the pores of the hollow pigment, it may be sufficient to apply the heat and pressure that is typically required by a fixing device during a fixing operation to provide an electrophotographic recording medium with high glossiness and excellent image quality such that a calendering process requiring high temperature and pressure may not be required.

Therefore, the present disclosure describes a printing medium for use in an electrophotographic printer that has high print glossiness and clear print quality along with the typical quality of the printing medium itself by adding the hollow pigment to the toner fixing layer without the need to perform a high temperature/pressure calendering process.

According to an embodiment, a mean particle size of the hollow pigment used in the toner fixing layer can be in the range of about 0.01 microns (μm) to about 2 μm. For example, the mean particle size of the hollow pigment may be about 2 μm or less, or, preferably, about 1 μm or less. When the mean particle size of the hollow pigment is greater than about 2 μm, the fixing device may require high temperature and pressure, which may be not be desirable in improving the glossiness. Alternatively, when the mean particle size of the hollow pigment is less than about 0.01 μm, it may be difficult to form pores in the particles of the hollow pigment due to the small size of the particles. Accordingly, the mean particle size of the hollow pigment may desirably be in the range of about 0.01 μm to about 2 μm.

The amount of the hollow pigment contained in the toner fixing layer may be in the range of about 10 percent (%) to about 50% by weight, or desirably in the range of about 15% to about 40% by weight, based on the total weight associated with the toner fixing layer.

When the amount of the hollow pigment is greater than about 50% by weight based on the total weight associated with the toner fixing layer, manufacturing costs can increase, the optical density and the image clarity can be reduced, and/or wrap jamming may occur while the recording medium is passed through the fixing device. On the other hand, when the amount of the hollow pigment is less than about 10% by weight based on the total weight associated with the toner fixing layer, the improvement in the glossiness that can result from using the hollow pigment may not be significant. Therefore, the amount of the hollow pigment may desirably be in the range of about 10% to about 50% by weight based on the total weight associated with the toner fixing layer.

The use of the hollow pigment can produce substantially the same effect as the calendering process, that is, the heat and pressure applied to the recording medium when the recording medium is passed through the fixing device can be sufficient so that there may be no need to perform the calendering process during the manufacturing of a recording medium. As a result, the manufacturing costs can be reduced while the glossiness of the printed portion and/or the unprinted portion (namely, the white portion) of the recording medium can be improved even after printing.

Additionally, the recording medium can have a sufficient roughness to transfer toner to the recording medium before the heat and pressure are applied to the recording medium by the fixing device. Thus, because a large amount of toner may be absorbed on a surface of the recording medium, the recording medium may have a high optical density after printing when compared to the optical density of a conventional recording medium in which roughness had been reduced by the calendering process.

Therefore, the use of the hollow pigment can address the manufacturing issues, e.g., related to the cost and to the calendering process, and may at the same time enable manufacture of recording media with excellent optical density and print glossiness.

In some embodiments, the hollow pigment used with the toner fixing layer can be an acryl-based pigment.

The toner fixing layer can further include additive agents to complement various properties of the electrophotographic recording medium, for example.

The additive agents used in the toner fixing layer can include, for example, a fluorescent dye. When the fluorescent dye is added to the toner fixing layer, the visual whiteness may be improved. The fluorescent dye can be used in the range of about 0.01% to about 0.5% by weight based on the total weight of the toner fixing layer. The additive agents can also include, for example, a hardener, a whitening agent, a light diffusing agent, a pH adjuster, an antioxidant, an anti-foaming agent, a leveling agent, a lubricant, an anti-curling agent, a surfactant, an anticorrosion agent, or the like, or any combination thereof.

When a toner fixing layer of a predetermined thickness is formed, there may not be a significant change in the ability of the layer to fix the toner even when the toner fixing layer is made thicker. As such, it may not be necessary to form a thick toner fixing layer. In practice, the thickness of the toner fixing layer may be in the range of about 5 μm to about 40 μm.

Figure 2:
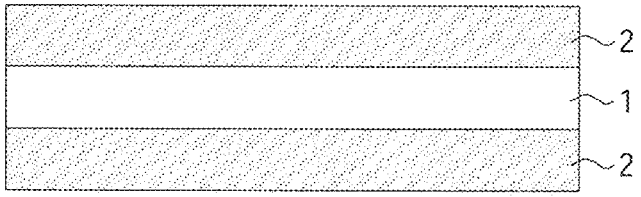
FIG. 2 is a cross-sectional view of an electrophotographic recording medium according to another embodiment of the present disclosure.

FIGS. 1 and 2 are cross-sectional views of electrophotographic recording media according to exemplary embodiments of the present disclosure. Each of the electrophotographic recording media shown in FIGS. 1 and 2 can include a base layer 1 and a toner fixing layer 2. In FIG. 1, the toner fixing layer 2 is formed on one surface of the base layer 1 while in FIG. 2, the toner fixing layer 2 is formed on both surfaces of the base layer 1. While the toner fixing layer 2 can be formed in a single-layered structure as shown in FIGS. 1 and 2, the toner fixing layer 2 can have a laminated structure including two or more layers on one surface or on both surfaces of the base layer 1.

To manufacture the electrophotographic recording medium according to embodiments of the present disclosure, a base layer and a composition to be used to form the toner fixing layer can be prepared. The prepared composition can then be coated on one surface or on both surfaces of the base layer.

A solvent can be used to coat the composition for the toner fixing layer on the base layer. The solvent can be, for example, a water base solvent that may be used when environmental concerns and workability are at issue. As alternatives to water, alcohols, glycol ethers, ketones, dimethyl formamide, or the like can also be used, taking into consideration the dissolving of the polymers and the drying after the coating.

The solvent used for the coating can be an alcohol such as, for example, methanol, ethanol, isopropanol, methyl cellosolve, or the like. The amount of the alcohols can be within about 50% of the total solvent.

The composition used to form a toner fixing layer can be coated on the base layer using various coating methods, including, for example, but not limited to, the use of a bar coater.

The composition coated on the base layer can be dried in an oven so that the toner fixing layer may form on the base layer to complete the manufacture of an electrophotographic recording medium.

To further illustrate various aspects of the present disclosure, several specific examples of electrophotographic recording media along with an empirical observations of the same are described below. It should be noted that the following examples are not intended to, and do not, limit the scope of the present disclosure.

EXAMPLES

Example 1

In this example, a coating material for the toner fixing layer is applied using a bar coater onto an art paper (e.g., paper produced by Hansol Paper Co., Ltd., Korea) having a basis weight of 140 grams-per-square meter (g/m$^2$). The coated art paper is then dried at 100 degrees Celsius (° C.) for 3 minutes to form a toner fixing layer having a weight about 20 g/m$^2$.

The prepared composition of the toner fixing layer in this example includes the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 70 parts by weight |
| Hollow pigment (HP-150, 1 μm, Synature, Inc., Korea) | 20 parts by weight |

Example 2

In this example, an electrophotographic recording medium is prepared in substantially the same manner as in Example 1, with a difference being that in this example the composition of the toner fixing layer is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 60 parts by weight |
| Hollow pigment (HP-150, 1 μm, Synature, Inc., Korea) | 30 parts by weight |

Example 3

In this example, an electrophotographic recording medium is prepared in substantially the same manner as in Example 1, with a difference being that in this example the composition of the toner fixing layer is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 50 parts by weight |
| Hollow pigment (HP-150, 1 μm, Synature, Inc., Korea) | 40 parts by weight |

Example 4

In this example, an electrophotographic recording medium is prepared in substantially the same manner as in Example 1, with a difference being that in this example the composition of the toner fixing layer is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 50 parts by weight |
| Hollow pigment (ROPAQUE ULTRA E, 0.34 μm, Rohm & Hass, U.S.A.) | 40 parts by weight |

Comparative Example 1

In this example, an electrophotographic recording medium is prepared in substantially the same manner as in Example 1, with a difference being that in this example the composition of the toner fixing layer is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 90 parts by weight |

Comparative Example 2

In this example, an electrophotographic recording medium is prepared in substantially the same manner as in Example 1, with a difference being that in this example the composition of the toner fixing layer is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 85 parts by weight |
| Hollow pigment (HP-150, 1 μm, Synature, Inc., Korea) | 5 parts by weight |

Comparative Example 3

In this example, an electrophotographic recording medium is prepared in substantially the same manner as in Example 1, with a difference being that in this example the composition of the toner fixing layer is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 30 parts by weight |
| Hollow pigment (HP-150, 1 μm, Synature, Inc., Korea) | 60 parts by weight |

Comparative Example 4

In this example, an electrophotographic recording medium is prepared in substantially the same manner as in Example 1, with a difference being that calendering is performed at 60° C. and at 500 pounds-per-squared inch (psi) using a Beloit Wheeler Model 753 SuperCalender (available from Beloit Wheeler company) after coating and drying of the coating material. The composition of the toner fixing layer in this example is prepared with the following components:

| | |
|---|---|
| Polyvinyl alcohol (F-05, DC Chemical Co., Ltd., Korea) | 2 parts by weight |
| Latex (SAV-4720, Synature, Inc., Korea) | 8 parts by weight |
| Calcium carbonate (COVERCARB 75, 0.5 μm, OMYA Korea Inc., Korea) | 90 parts by weight |

Test and Results

1. Test for White Paper Glossiness

White paper glossiness of the electrophotographic recording media prepared in Examples 1 to 4 and Comparative Examples 1 to 4 are measured using a Microgloss Ref-160 available from Sheen Instruments Inc. The test results are listed below in Table 1.

TABLE 1

Comparison of White Paper Glossiness

| | White Paper Gossiness before passing through fixing device ($G_0$) | | White Paper Glossiness after passing through fixing device ($G_p$) | | $G_p/G_0$ | |
|---|---|---|---|---|---|---|
| | 60° | 85° | 60° | 85° | 60° | 85° |
| Example 1 | 10 | 25 | 33 | 55 | 3.30 | 2.2 |
| Example 2 | 13 | 30 | 37 | 61 | 2.85 | 2.03 |
| Example 3 | 15 | 33 | 40 | 68 | 2.67 | 2.06 |
| Example 4 | 20 | 40 | 43 | 71 | 2.15 | 1.78 |
| Comparative Example 1 | 8 | 18 | 10 | 20 | 1.25 | 1.11 |
| Comparative Example 2 | 10 | 20 | 17 | 28 | 1.70 | 1.40 |
| Comparative Example 3 | 15 | 30 | 40 | 65 | 2.67 | 2.17 |
| Comparative Example 4 | 30 | 60 | 35 | 60 | 1.17 | 1.00 |

In the above results in Table 1, higher figure indicates the higher white paper glossiness exhibited by the electrophotographic recording medium.

A description of the measurement of the white paper glossiness ($G_p$) after passing through a fixing device follows. White paper is printed using an HP color LaserJet 2600 printer available from Hewlett Packard Co., and then the glossiness of the surface of the printed paper is measured using a Microgloss Ref-160 glossmeter. Again, higher figure indicates higher white paper glossiness.

In this test, the white paper glossiness is measured twice, once at an incidence angle of 60° and once at an incidence angle of 85° using the Microgloss Ref-160 glossmeter.

The results of Table 1 illustrates that before passing through the fixing device, the white paper glossiness of the electrophotographic recording media prepared in Examples 1 to 3 showed a tendency to increase as the amount of the hollow pigment increased. Additionally, after passing through the fixing device, the electrophotographic recording media in Examples 1 to 4 and Comparative Examples 2 and 3, in each of which the hollow pigment is added to the toner fixing layer, have excellent white paper glossiness.

Before passing through the fixing device, the electrophotographic recording medium in Comparative Example 4, in which no hollow pigment is added, and to which the calendering process had been performed, has significantly higher white paper glossiness than other electrophotographic recording media. However, after passing through the fixing device, there was no great change in the white paper glossiness of the electrophotographic recording medium in Comparative Example 4. In other words, the fixing operation had no influence on the change in the white paper glossiness in the case of the Comparative Example 4. On the other hand, when the hollow pigment is added to the toner fixing layer rather than performing the calendering process—as is the case in Examples 1 to 4 and Comparative Examples 2 and 3—the overall increase in the white paper glossiness by the fixing operation is observed.

As a result, the values of the ratio $G_p/G_0$ of the electrophotographic recording media prepared in Examples 1 to 4 are higher than the values of the ratio $G_p/G_0$ of the electrophotographic recording media prepared in Comparative Examples 1, 2, and 4. The electrophotographic recording medium in Comparative Example 2 has the hollow pigment, but the amount of the hollow pigment is insignificant, so the white paper glossiness did not increase markedly during the fixing operation. On the other hand, the electrophotographic recording medium in Comparative Example 3 has a large amount of the hollow pigment, so an increase in the white paper glossiness is clearly observed.

Therefore, it could be deduced that at least a predetermined amount of the hollow pigment may need to be added to the toner fixing layer to obtain an electrophotographic recording medium with high glossiness without the need to perform the calendering process.

2. Tests for Print Glossiness and Optical Density

Test results for print glossiness and optical density of the electrophotographic recording media prepared in Examples 1 to 4 and Comparative Examples 1 to 4 are listed below in Table 2.

TABLE 2

Comparison of Print Glossiness and Optical Density

| | Print Glossiness | | Optical Density | |
|---|---|---|---|---|
| | 60° | 85° | Magenta | Black |
| Example 1 | 21 | 58 | 1.00 | 1.68 |
| Example 2 | 22 | 64 | 1.02 | 1.73 |
| Example 3 | 25 | 67 | 1.03 | 1.75 |
| Example 4 | 27 | 68 | 1.03 | 1.76 |
| Comparative Example 1 | 10 | 19 | 0.90 | 1.60 |
| Comparative Example 2 | 13 | 30 | 1.01 | 1.69 |
| Comparative Example 3 | 25 | 70 | 0.85 | 1.43 |
| Comparative Example 4 | 20 | 55 | 0.86 | 1.50 |

In this test, a black block is printed on the coated paper using an HP color LaserJet 2600 printer, and the print glossiness of the printed portion of the coated paper is measured using a Microgloss Ref-160 glossmeter. Higher figure indicates the higher print glossiness. The print glossiness is obtained by measuring the glossiness of the printed portion of the electrophotographic recording media rather than the unprinted portion (i.e., the white portion), and may thus be different from the white paper glossiness shown in Table 1.

In addition, magenta and black images are printed using the HP color LaserJet 2600 printer that is used in the print glossiness measurement described above, and the optical density thereof is measured using a SpectroEye spectrophotometer available from GretagMacbeth (U.S.A.). Higher figure in the table indicates higher level of clearness. In this test, a measured value of about ±0.01 is within the range of error. A value difference of about 0.1, for example, however may indicate a significant difference in clearness.

The results of Table 2 illustrate that when the hollow pigment is added to the toner fixing layer (as is the case in Examples 1 to 4 and Comparative Examples 2 and 3), a higher print glossiness and a higher image clearness are obtained when compared to those other examples (i.e., the Comparative Examples 1 and 4) with no hollow pigment added. However, when an excessive amount of hollow pigment is added (see Comparative Example 3), the image clarity can deteriorate. It may thus be important to control the amount of the hollow pigment.

As described above, when a suitable amount of hollow pigment is contained in the toner fixing layer, it is possible to manufacture an electrophotographic recording medium that can have improved white paper glossiness after passing through a fixing device, thereby providing an improved image clarity with high print glossiness.

The foregoing embodiments and features are merely given by way of examples, and are not to be construed as limiting the full scope of the present disclosure, and many alternatives, modifications, and variations of the disclosed embodiments will be apparent to those skilled in the art. Aspects of the present disclosure can be readily applied to other types of apparatuses.

What is claimed is:

1. An electrophotographic recording medium, comprising:

a base layer defining two surfaces; and a toner fixing layer covering at least on one of the two surfaces defined by the base layer, wherein the toner fixing layer comprises a hollow pigment, calcium carbonate and a binder resin, wherein the binder resin comprises polyvinyl alcohol and latex;

wherein an amount of the hollow pigment in the toner fixing layer is in the range of about 10 to about 50 percent by weight based on total weight of the toner fixing layer, wherein an amount of calcium carbonate in the toner fixing layer is in the range of about 50 to about 70 percent by weight based on total weight of the toner fixing layer, wherein the toner fixing layer includes about 2 parts by weight of a polyvinyl alcohol, about 8 parts by weight of a latex, about 50-70 parts by weight of a calcium carbonate and about 20-40 parts by weight of the hollow pigment;

wherein the toner fixing layer has a thickness greater than 25 μm and less than or equal to 40 μm; and wherein a ratio $G_p/G_0$ is greater than 1.5, $G_0$ and $G_p$ representing white paper glossiness of the electrophotographic recording medium measured respectively before and after a performance of a printing operation on the electrophotographic recording medium.

2. The electrophotographic recording medium of claim 1, wherein a mean particle size of the hollow pigment is in the range of about 0.01 microns (μm) to about 2 μm.

3. The electrophotographic recording medium of claim 1, wherein a content ratio of the calcium carbonate to the binder resin is in the range of about 95:5 to about 50:50.

4. The electrophotographic recording medium of claim 1, wherein the toner fixing layer further comprises an additive agent.

5. The electrophotographic recording medium of claim 4, wherein the additive agent is a fluorescent dye in the range of about 0.01 percent by weight to about 0.5 percent by weight based on the total weight of the toner fixing layer.

6. The electrophotographic recording medium of claim 4, wherein the additive agent comprises at least one selected from the group consisting of a fluorescent dye, a hardener, a whitening agent, a light diffusing agent, a pH adjuster, an antioxidant, an antifoaming agent, a leveling agent, a lubricant, an anti-curling agent, a surfactant and an anticorrosion agent.

7. The electrophotographic recording medium of claim 1, wherein an amount of the hollow pigment in the toner fixing layer is in the range of about 15 percent by weight to about 40 percent by weight based on the total weight of the toner fixing layer.

* * * * *